US006349576B2

(12) United States Patent
Subliskey

(10) Patent No.: US 6,349,576 B2
(45) **Date of Patent: *Feb. 26, 2002**

(54) LOCKABLE SASH ASSEMBLY

(75) Inventor: Edward J. Subliskey, Mountain Top, PA (US)

(73) Assignee: Allen-Stevens Corp., Owatonna, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/947,406

(22) Filed: Oct. 8, 1997

(51) Int. Cl.[7] ..... E05B 65/08

(52) U.S. Cl. ..... 70/90; 70/95; 70/100; 292/204; 292/210; 292/DIG. 20; 292/DIG. 47

(58) Field of Search ..... 70/87, 90, 95–97, 70/99, 100; 292/DIG. 20, DIG. 47, 210, 204, 209

(56) References Cited

U.S. PATENT DOCUMENTS

| | | | | | |
|---|---|---|---|---|---|
| 315,307 | A | * | 4/1885 | Ludlow | 70/90 |
| 404,145 | A | * | 5/1889 | Abbott | 70/90 |
| 462,183 | A | * | 10/1891 | Varney | 292/DIG. 20 X |
| 532,935 | A | * | 1/1895 | Woolery | 292/DIG. 20 X |
| 639,546 | A | * | 12/1899 | Fergusson | 292/DIG. 20 X |
| 717,855 | A | * | 1/1903 | Houghton | 292/210 X |
| 769,767 | A | * | 9/1904 | Phelps | 292/DIG. 20 X |
| 826,343 | A | * | 7/1906 | Mason | 292/DIG. 20 X |
| 1,163,838 | A | * | 12/1915 | Maul | 292/204 X |
| 1,197,228 | A | * | 9/1916 | Nelson | 292/DIG. 20 X |
| 1,569,849 | A | * | 1/1926 | Bowles | 292/DIG. 20 X |
| 2,181,313 | A | * | 11/1939 | Blodgett | 292/210 X |
| 2,190,205 | A | * | 2/1940 | Birman | 70/90 |
| 2,214,884 | A | * | 9/1940 | Kistner | 70/89 |
| 2,585,375 | A | * | 2/1952 | Dixon | 70/89 |
| 2,613,526 | A | * | 10/1952 | Holmsten | 70/90 |
| 3,395,490 | A | * | 8/1968 | Diack | 70/90 |
| 3,468,142 | A | * | 9/1969 | Sprung | 70/89 |
| 3,548,621 | A | * | 12/1970 | Rossetti | 70/370 |
| 3,593,547 | A | * | 7/1971 | Taylor | 70/89 |
| 3,599,452 | A | * | 8/1971 | Yokohama et al. | 70/90 X |
| 3,600,019 | A | * | 8/1971 | Toyota et al. | 70/90 X |
| 4,036,039 | A | * | 7/1977 | Nakanishi | 70/90 |
| 4,045,982 | A | * | 9/1977 | Gorton et al. | 70/90 |
| 4,381,656 | A | * | 5/1983 | Hayakawa | 70/370 X |
| 4,736,972 | A | | 4/1988 | Mosch | 292/204 |
| 5,015,019 | A | * | 5/1991 | Razdolsky | 292/210 X |
| 5,435,159 | A | * | 7/1995 | Ramsauer | 70/370 |
| 5,540,066 | A | * | 7/1996 | Takimoto | 292/210 X |
| 5,551,268 | A | * | 9/1996 | Carnes et al. | 70/370 |

FOREIGN PATENT DOCUMENTS

| | | | | |
|---|---|---|---|---|
| DE | 461343 | * | 6/1928 | 292/204 |
| EP | 0044264 | * | 1/1982 | 70/90 |
| EP | 0405252 | * | 1/1991 | 70/89 |
| FR | 321367 | * | 1/1903 | 292/210 |
| GB | 467961 | * | 6/1937 | 70/89 |
| GB | 2258008 A | * | 1/1993 | 292/204 |
| NO | 87587 | * | 4/1956 | 292/204 |

OTHER PUBLICATIONS

1993 Truth Hardware Key Lock Brochure.

* cited by examiner

*Primary Examiner*—Lloyd A. Gall
(74) *Attorney, Agent, or Firm*—Lorusso & Loud

(57) ABSTRACT

A lockable sash assembly for installation on a window assembly is provided. The window assembly includes sashes movable relative to each other to open and close the window assembly when the lockable sash assembly is in a window-openable condition and substantially unmovable relative to each other when the lockable sash assembly is in a window-unopenable condition. The sash assembly includes a sashlock having a rotating device (such as a lever-controlled cam) which is movable between a window-openable position and a window-unopenable position. The sash assembly also includes a locking device which is convertible between a locked state whereat the rotating device is blocked from moving from the window-unopenable position to the window-openable position and an unlocked state whereat the rotating device is unblocked from moving from the window-unopenable position to the window-openable position.

18 Claims, 9 Drawing Sheets

LOCKABLE SASH ASSEMBLY

FIELD OF THE INVENTION

The invention relates generally to a sashlock assembly and more particularly to a sashlock assembly which includes a key lock to retain the sashlock in a latched position.

BACKGROUND OF THE INVENTION

In a double hung window assembly a pair of sashes are mounted in a frame and movable vertically to open or close the window. When the window is closed, usually there is only a small gap, if any, between the top rail of the lower sash and the bottom rail of the top sash.

A sashlock assembly is commonly used with double hung windows. When the window assembly is closed, the sashlock assembly is shifted from an unlatched position to a latched position to keep the window closed. A sashlock assembly usually includes a sashlock mounted on the top rail of the bottom sash and a keeper mounted on the bottom rail of the top sash. The rails may provide horizontal mounting surfaces on the respective sashes that are flush when the window is closed. In some applications, especially with extruded vinyl or aluminum sash rails, the keeper or the sashlock or both may be secured to vertical surfaces or to specially formed slots or recesses in the rails.

A sashlock typically comprises a housing and a rotating assembly which includes a rotating member and a lever. The rotating member, usually a cam, is mounted to the housing for rotation between an unlatched position and a latched position. The lever is operably connected to the cam and extends outside of the housing so that the cam may be conveniently moved between the latched and unlatched positions. When the sashlock is in the unlatched position, the cam is retracted and thus disengaged from the keeper, and the sashes may be moved relative to each other. When the sashlock is in the latched position, a portion of the cam engages the keeper to prevent movement of the sashes.

Unfortunately, sashlocks are sometimes vulnerable to unauthorized tampering from the outside of the building which shifts the sashlock from the latched to the unlatched position. For example, with some prior art sashlocks, it is possible from the outside of the building to insert a blade into the gap between the two sashes, engage the cam with the blade, and force the cam back to its unlatched position. The window may then be opened from the outside of the building to provide access into the building.

SUMMARY OF THE INVENTION

The present invention provides a lockable sashlock assembly which eliminates, or at least reduces the chances of, successful unlatching of the sashlock from outside the building. Particularly, the invention provides a lockable sashlock assembly which may be locked in the latched condition. In this specification the terms "latched" and "unlatched" are used with reference to the engagement between the cam of the sashlock and the keeper. The terms "locked" and "unlocked" are used with reference to a safety lock device used to hold the cam in its latched position.

The lockable sashlock assembly according to the present invention includes a sashlock having a rotating device and a safety lock mechanism. The rotating device (usually a cam) is movable between an unlatched position in which the window assembly is openable and a latched position in which the window assembly is unopenable. The safety lock mechanism has a locked state in which the rotating device is retained in its latched position, thus securing the window assembly against forced entry. The safety lock mechanism may be switched to an unlocked state in which the rotating device is free to turn between its latched and unlatched states. The locking mechanism includes a key slot and is convertible from the locked state to the unlocked state upon insertion of an appropriately shaped key in the key slot.

Accordingly, the sashlock assembly may be locked so that even if a blade is inserted into the gap between the two sashes to engage the rotating member, it will still not be possible to force the cam back to its unlatched position. Additionally, since in the preferred embodiment a key is necessary to turn the safety lock mechanism to the unlocked state, the lockable sashlock assembly according to the present invention can also be used to control window openings inside the building. For example, if a facility's regulations forbid the opening of windows in certain designated areas, the relevant sashlocks can be placed in the locked state and only authorized personnel provided with the key.

The invention comprises these and other features hereinafter fully described in the specification and particularly pointed out in the claims. The following description and the annexed drawings set forth in detail certain illustrative embodiments of the invention, these being indicative, however, of but a few of the various ways in which the principles of the invention may be suitably employed.

DRAWINGS

FIGS. 5A, 5B, 5C, and 5D are top, bottom, inner side and end views, respectively, of the cam of the sashlock.

Figure 6B:
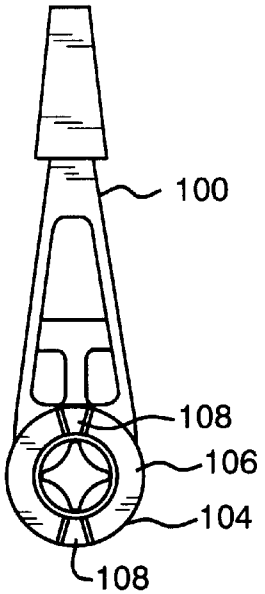
Figure 6A:
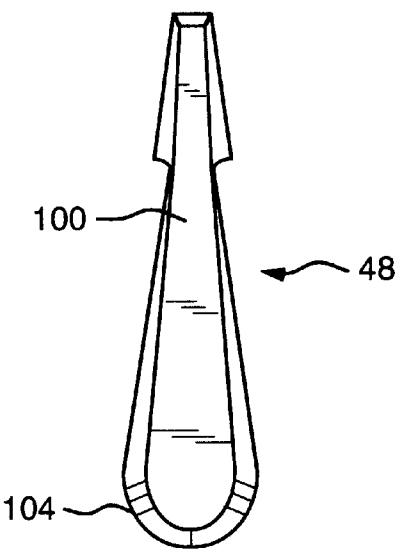
Figure 6C:
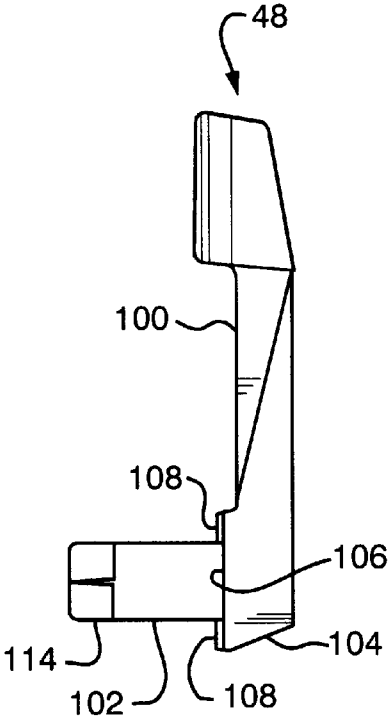

FIGS. 6A, 6B, and 6C are top, bottom, and side views, respectively, of the lever of the sashlock.

Figure 7:
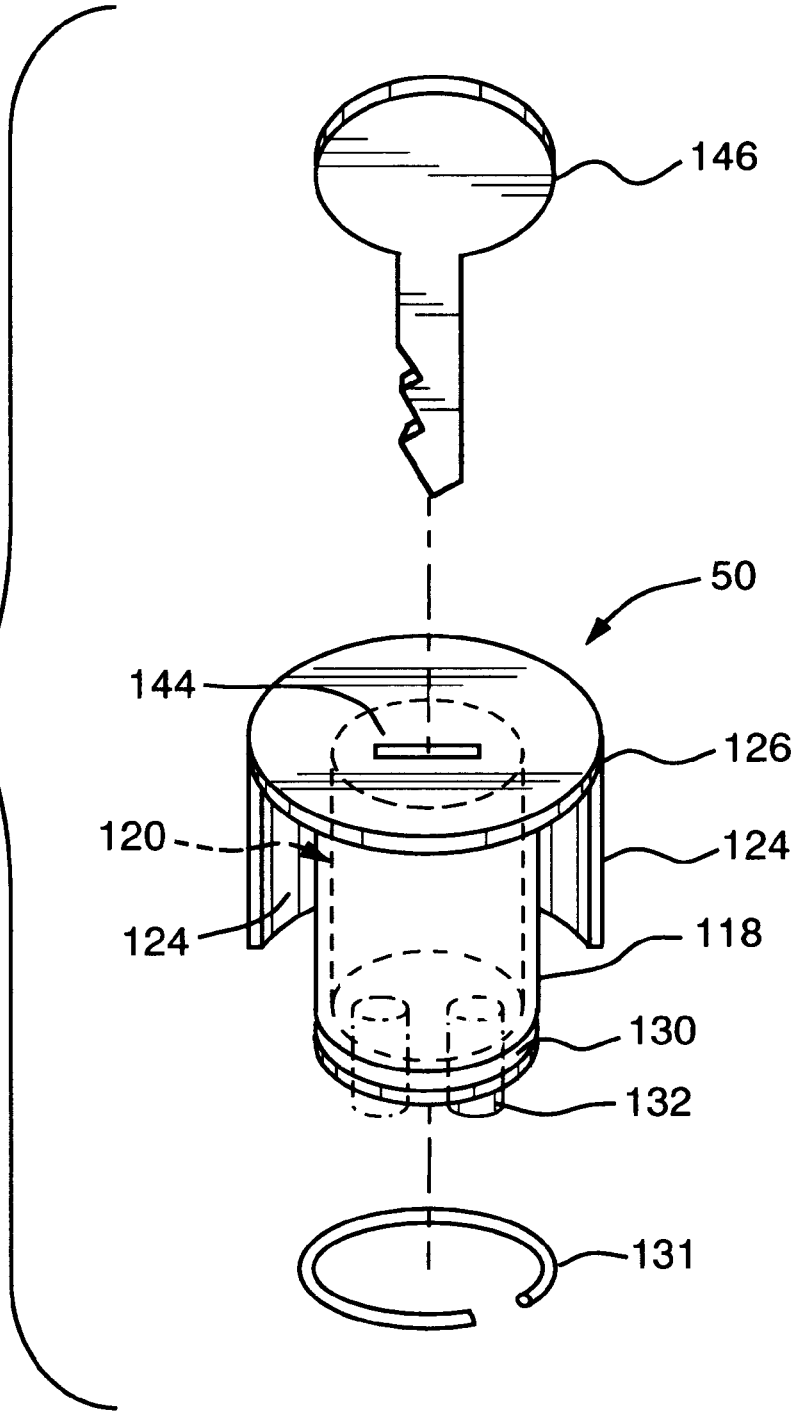

FIG. 7 is a perspective illustration of the safety locking mechanism of the sashlock.

FIGS. 8A, 8B, 8C, and 8D are top, bottom, inner side and outer side views, respectively, of the keeper of the lockable sash assembly.

Figures 8A, 8B, 8C, 8D, 8E:
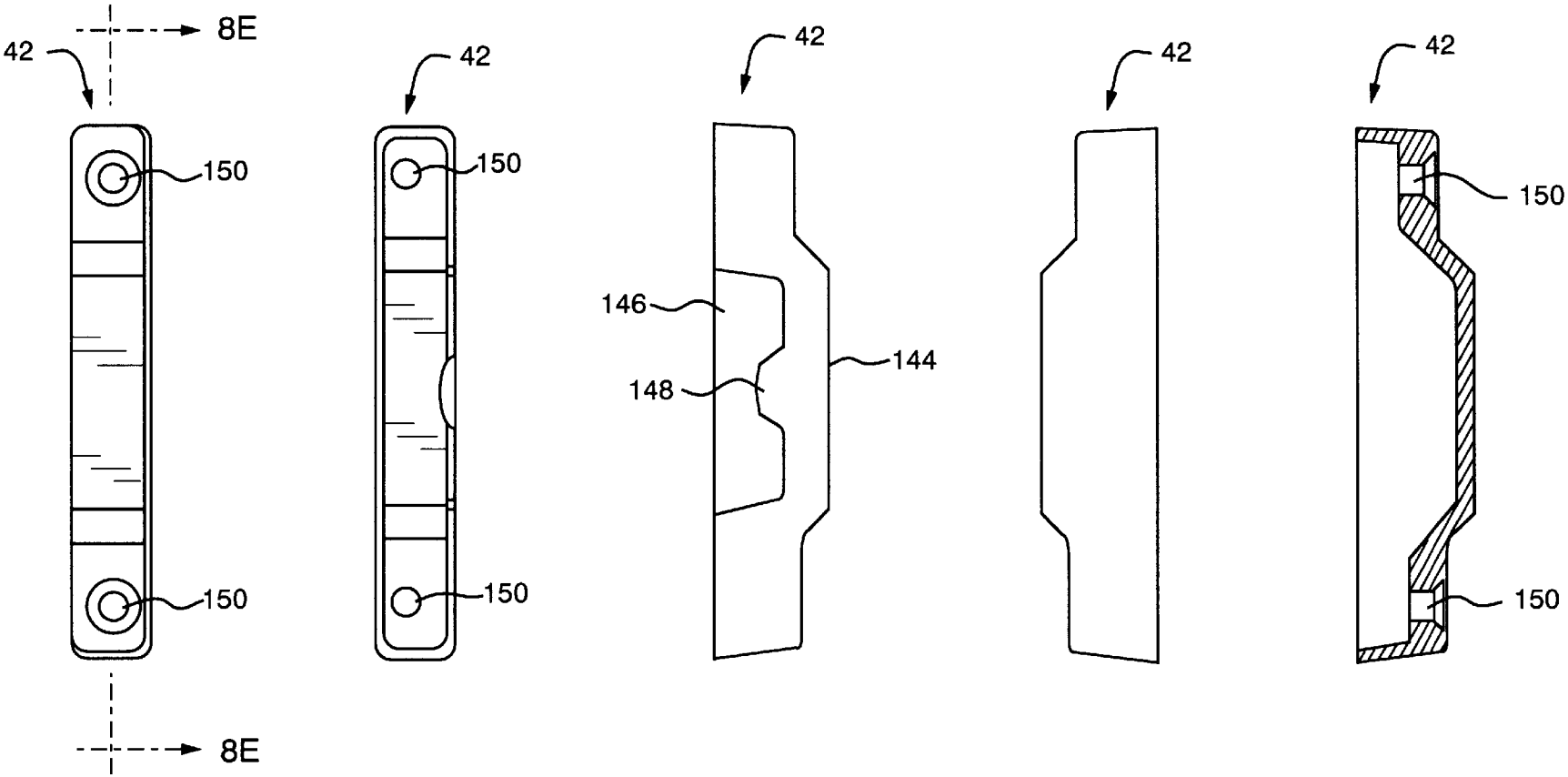

FIG. 8E is a sectional view as seen along line 8E–8E in FIG. 8A.

DETAILED DESCRIPTION

Figure 1:
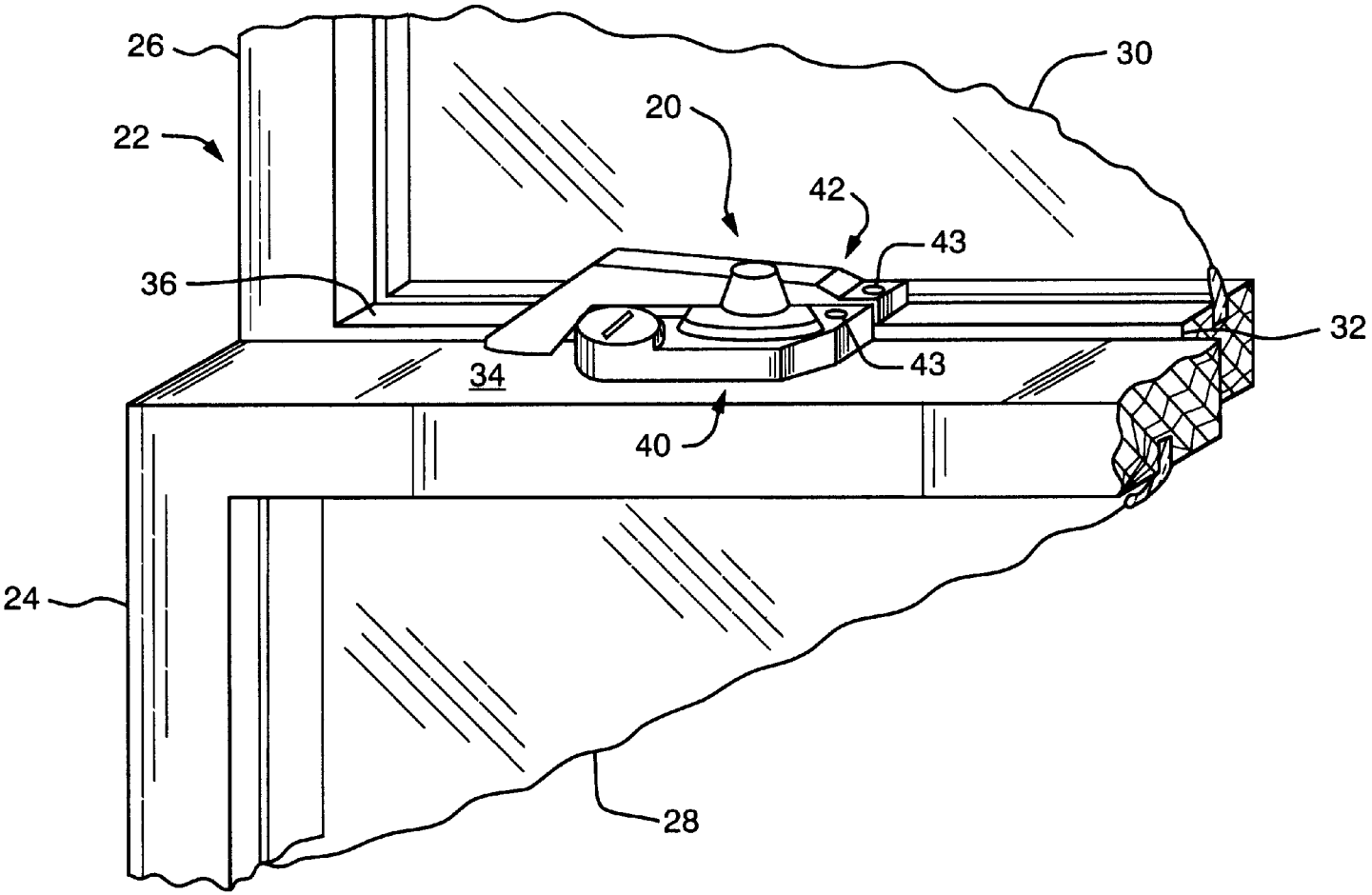
FIG. 1 is a perspective illustration, partially cut away, of a sashlock assembly according to the present invention, the sashlock assembly being shown installed on a double hung window assembly.

FIG. 1 shows a lockable sashlock assembly 20 according to the present invention mounted on a window assembly 22. As is explained in more detail below, the lockable sashlock assembly 20 eliminates, or at least reduces the chances of, successful unauthorized opening of the window assembly 22 from outside or inside a building.

The window assembly 22 includes a lower sash 24 and an upper sash 26 which hold glass panes 28 and 30, respectively. The lower sash 24 is positioned parallel to the upper sash 26 and adjacent thereto, with only a small gap 32 separating the sashes. The sashes 24 and 26 are mounted for relative linear movement to open and close the window assembly 22. When the window assembly 22 is closed as shown in FIG. 1, a horizontal surface 34 on a rail of the lower sash 24 is aligned or flush with a horizontal surface 36 on a rail of the upper sash 26.

The lockable sashlock assembly 20 according to the present invention includes a sashlock 40 and a keeper 42. The sashlock 40 and the keeper 42 are permanently mounted on the surfaces 34 and 36 with suitable fasteners such as screws 43. Specifically, the sashlock 40 is mounted on the lower sash 24 and the keeper 42 is mounted on the upper sash 26. The sashlock 40 and the keeper 42 are substantially flush with the corresponding faces of the sash rails which define the gap 32 (see FIG. 2). When the window assembly 22 is closed, the lockable sashlock assembly 20 can be moved between latched and unlatched positions to lock the window shut or allow it to be opened, respectively.

The sashlock 40 comprises a housing 44 (FIGS. 3A and 3B), a rotating device including a cam 46 and a lever 48, and a locking device 50. As is explained in more detail below, the cam 46 is a rotating member. It is mounted for rotational movement within the housing 44 between a position corresponding to the openable condition of the sashlock 40 (i.e., unlatched) and a position corresponding to the unopenable condition of the sashlock (i.e., latched). The lever 48 is operably connected to the cam 46 to move it between these positions. The locking device 50 may be locked while the sash assembly 20 is in the closed condition. (See FIGS. 3A and 3B.) In this manner, unintended and/or unwanted tampering with the sashlock 40 which forces it back to the unlatched condition to open the window assembly 22 is impossible or at least more difficult.

FIGS. 4A–4G show the housing 44 of the sashlock 40 in various views. The housing 44 includes an inner wall 52, an outer wall 54, and a top wall 56. The inner wall 52 is approximately perpendicular to the horizontal surface 34 of the lower sash 24. The outer wall 54 is roughly C-shaped in plan view and connects opposite ends of the inner wall 52 and the top wall 56 which has complementary shape.

Figure 2:
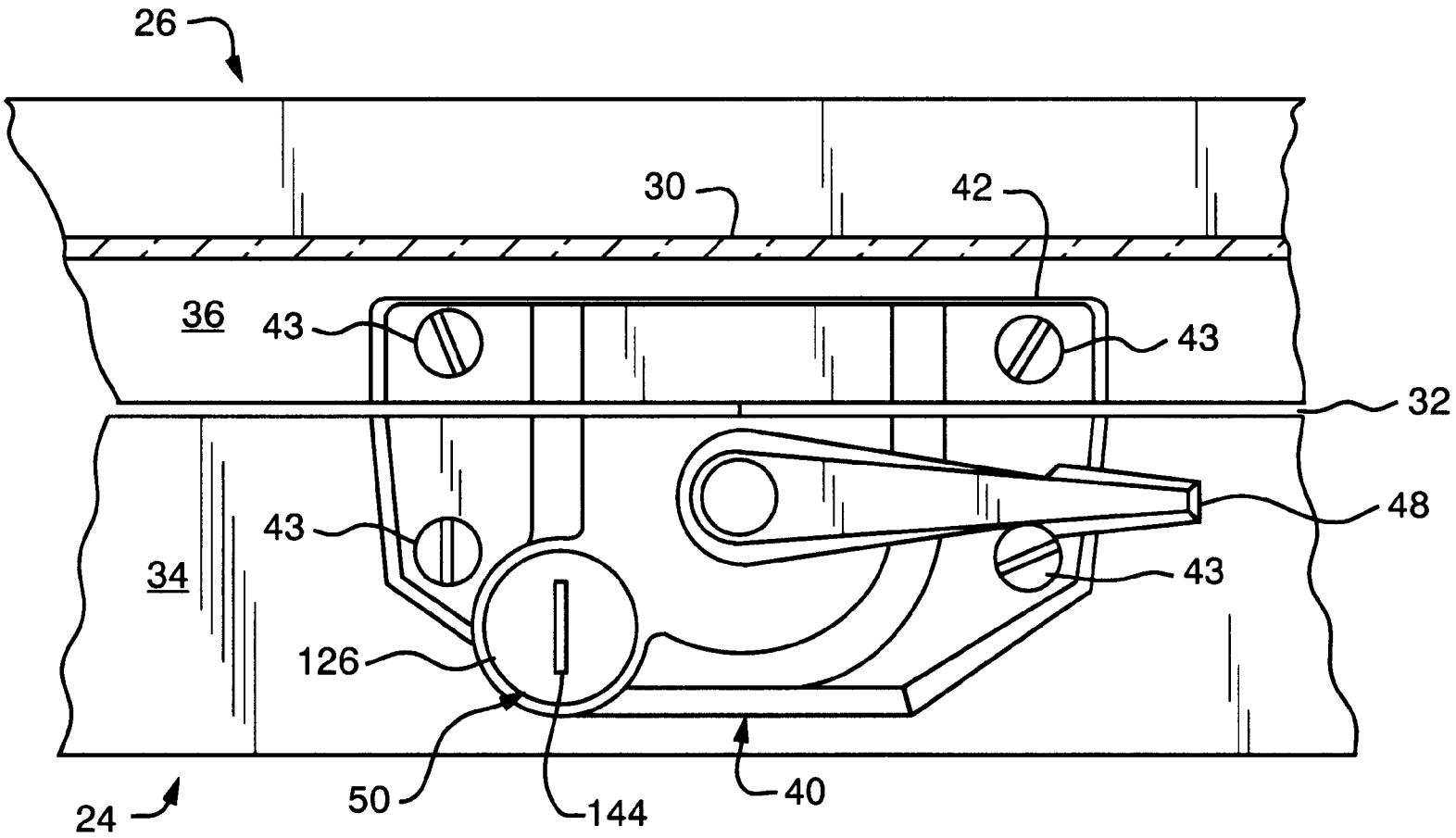
FIG. 2 is a top view of the sashlock assembly of FIG. 1 and which includes a sashlock and a keeper.

The housing walls 52, 54 and 56 define an internal chamber 58 (FIGS. 4B, C, F, and G) to receive the cam 46. See FIGS. 3A and 3B. The inner wall 52 includes an opening 60 from the chamber 58. (See FIG. 4C.) The top wall 56 includes openings 63 (FIGS. 4A and 4B) which receive fasteners 43 to mount the housing 44 (and thus the sashlock 40) to the top surface 34 of the lower sash 24 as shown in FIGS. 1 and 2.

The sashlock's housing 44 (FIGS. 4B and C) also includes an internal wall 64 within the chamber 58 which defines a central cylindrical passage 68 through an opening in the top wall 56. (See FIG. 4F.) The cylindrical wall of the passage 68 is generally vertically oriented and forms a vertical bearing surface to support the shaft 102 (FIG. 6C) of the lever 48 which is operably coupled to the cam 46. Radial lever-set grooves 69 (see FIG. 4A) are formed in the top of the wall 64. As described below they cooperate with corresponding ridges 108 (FIG. 6B) on the handle to provide a positive feel when the lever is in either of its two extreme positions. The bottom of the wall 64 of the housing 44 also includes radial position-set tabs 70 and 71 (see FIGS. 4B and 4C). The tabs 70 and 71 cooperate with a stop pin 82 (FIG. 5A) on the cam 46 to limit rotation of the cam to about 180°.

Figure 3A:
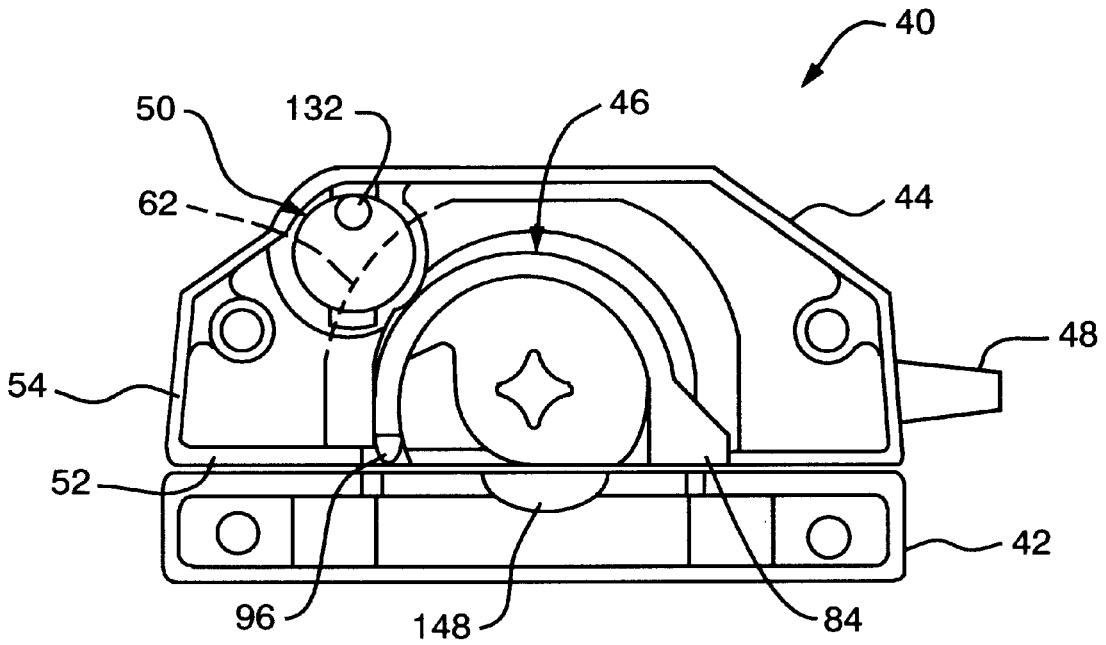
FIGS. 3A and 3B are bottom views of the sashlock assembly of FIG. 2, the sashlock being shown with its safety lock mechanism unlocked and its cam unlatched from the keeper (FIG. 3A) and with its safety lock mechanism locked and its cam latched with the keeper (FIG. 3B).
Figure 3B:
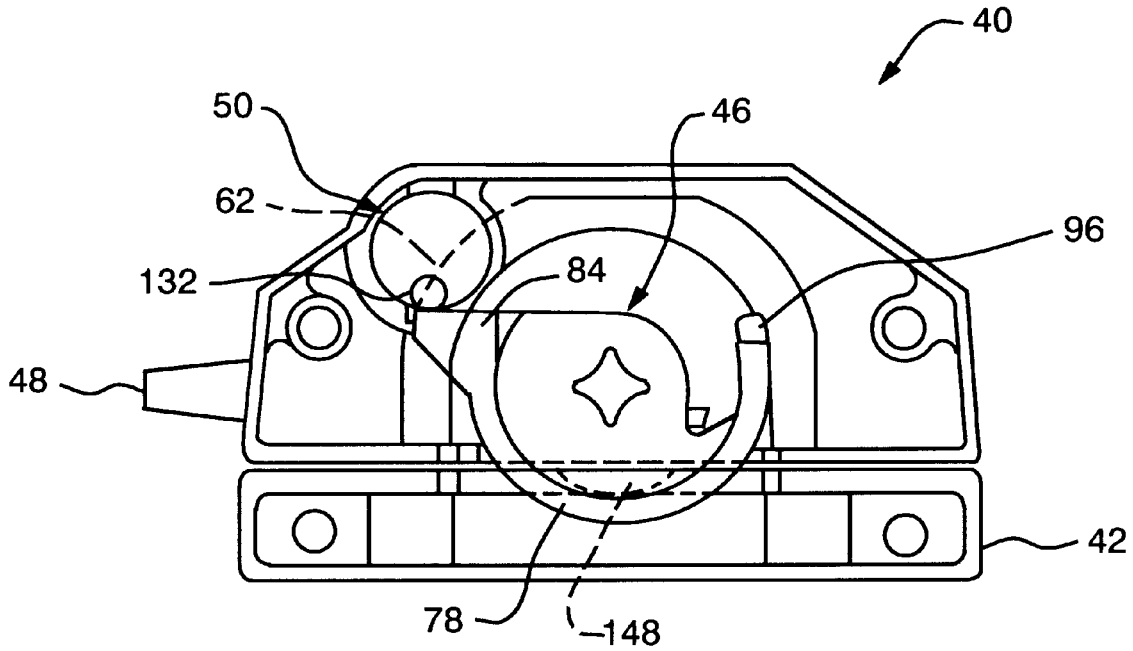
Figure 4A:
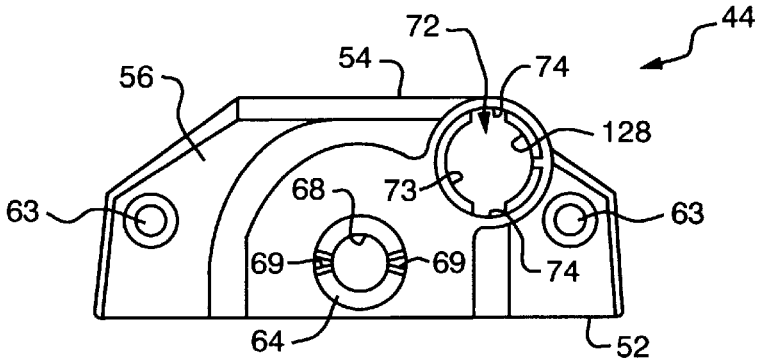
FIGS. 4A, 4B, 4C, 4D and 4E are top, bottom, inner side, outer side and end views, respectively, of the housing of the sashlock.
Figure 4B:
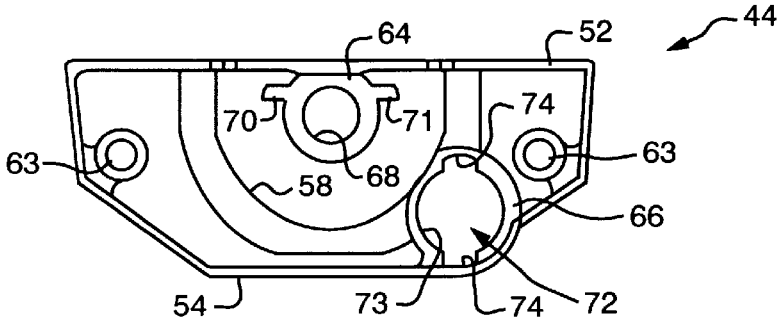
Figure 4C:
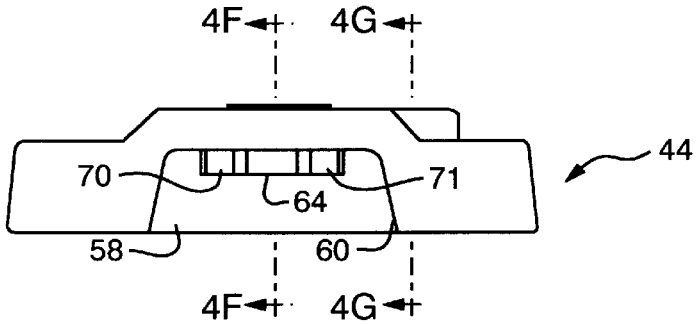
Figure 4D:
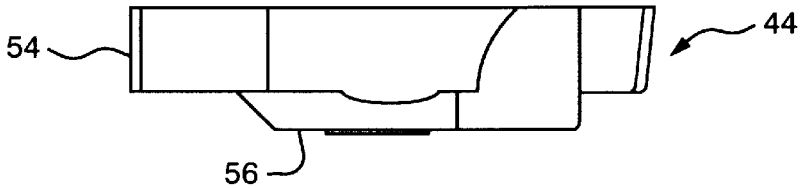
Figure 4E:
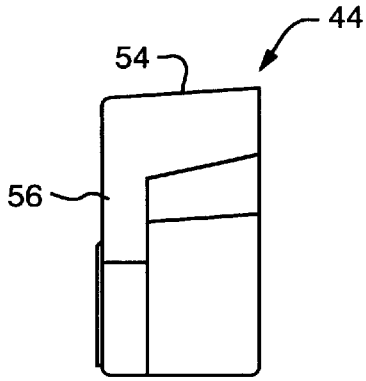
Figure 4F:
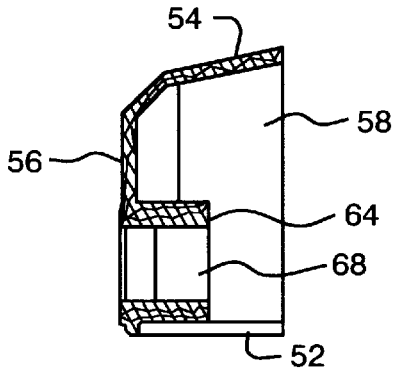
FIG. 4F is a sectional view taken along line 4F—4F in FIG. 4C.
Figure 4G:
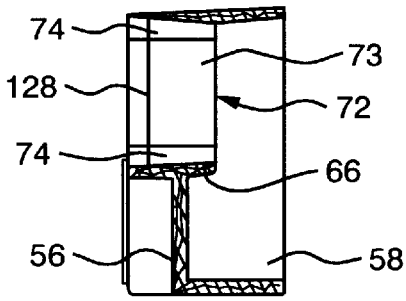
FIG. 4G is a sectional view taken along line 4G—4G in FIG. 4C.

The cam 46 shown in FIGS. 5A–D is shaped to fit within the chamber 58 of the housing 44 (see FIG. 3A) and to engage the keeper (see FIG. 3B). The cam 46 (FIGS. 5A–D) includes a central hub 86 which is generally cylindrical. The hub 86 includes a central opening 95 in the shape of a four-pointed star or a four-toothed gear. (See FIG. 5B.) In the assembled sashlock 40, the opening 95 cooperates with a similarly shaped end portion 114 (see FIG. 6C) of the lever 48. During assembly of the sashlock 40, the portion 114 of the lever 48 is deformed or swaged into the opening 95 of the cam 46 so that the cam 46 and the lever 48 will rotate together about the vertical axis defined by the lever shaft passage.

FIGS. 6A through 6D show the handle 48 in orthographic views. The handle 48 includes a lever 100 connected to a shaft 102. The shaft 102 is generally perpendicular to the lever. The shaft 102 is proportioned to fit and rotate within the cylindrical passage 68 through the top of the housing 44.

The lever 100 meets the shaft 102 at a hub 104. The hub 104 includes an annular bottom surface 106 which is the same size as the top of the wall 64 in the housing 44. The annular bottom surface 106 is interrupted by a pair of raised detents 108 which fit in the lever set grooves 69 in the wall 64 of the housing.

The detents 108 and grooves 69 provide a positive feel when the lever is in the fully open position (FIG. 3A) or the fully closed position (FIG. 3B). This is accomplished by means of a conventional wave washer (sometimes called a "Belleville" washer) (not shown) which surrounds the shaft 102 between the cam 46 and the inside of the housing 48. The washer provides a spring bias that pushes the detents 108 into the similarly shaped grooves 69 in the housing. Accordingly, once the handle and hub are connected, rotation of the handle 48 causes the cam 46 to rotate similarly and to snap into the fully open position (FIG. 3A) or the fully closed position (FIG. 3B).

A web 76 (FIGS. 5A–D) extends radially outward from the hub 86 of the cam 46. The web 76 serves to connect the various other components of the cam 46 to the hub 86. Specifically, a peripheral rim 78 extends around approximately 180° of the hub 86. The rim 78 is arcuate in plan view, and it has a generally rectangular cross section. The rim 78 extends both above and below the plane of the web 76. For approximately 90° around web 86 (from about 10:30 o'clock to about 1:30 o'clock in FIG. 5A), the rim 78 has a full rectangular cross section. For the succeeding 90° (proceeding clockwise as viewed in FIG. 5A) the rim 78 tapers downwardly along inclined face 79 to a rounded tip 96. The bottom surface of the rim 78 tapers upward to the rounded tip 96, but does so over an extent of only about 10°. The inclined face 79 of the rim 78 serves to engage the keeper 42 and to draw the two sashes into proper alignment as the cam 46 is rotated.

The cam 46 also includes a stop pin 82. The stop pin 82 extends upward (as viewed in FIGS. 5C and 5D) from the web 76. The stop pin 82 cooperates with the tabs 70 and 71 in the housing 44 to limit the rotation of the cam to approximately 180°. In each of the limit positions, one side of stop pin 82 engages one or the other of the tabs 70 and 71.

Figure 5A:
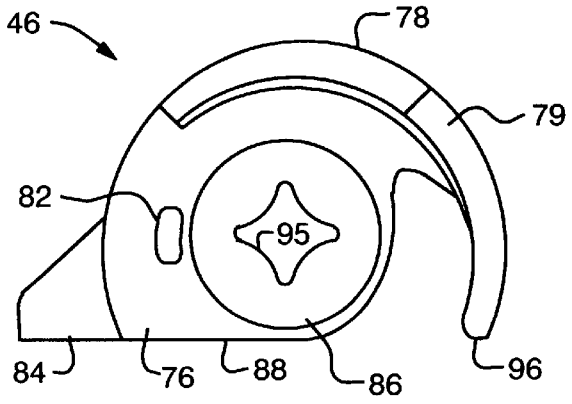
Figure 5B:
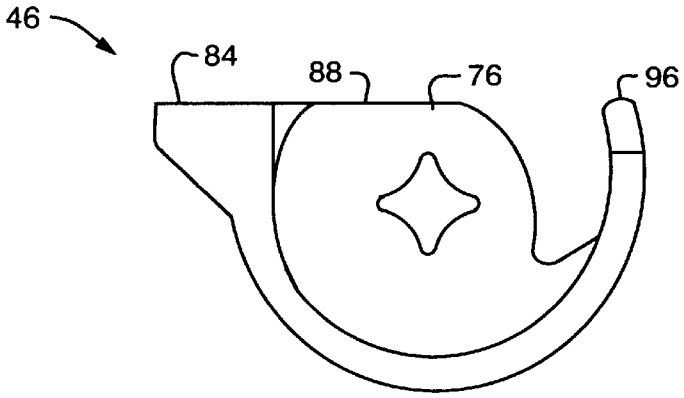
Figure 5C:
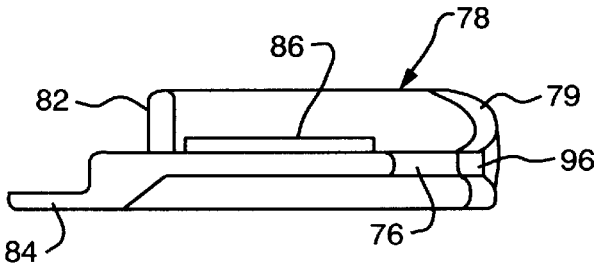
Figure 5D:
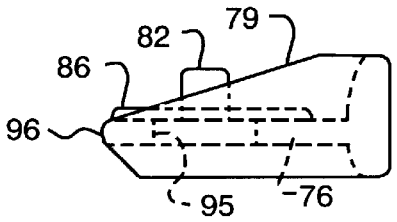

The web 76 is bounded in part by a straight edge 88 which extends approximately tangent to the hub 86 from a 6 o'clock position as viewed in FIG. 5A. The edge 88 is positioned so that when the sashlock 40 is in the open position (FIG. 3A) the edge 88 is even with the inner wall 52 of the housing, as is the tip 96 of the rim 78.

The final component of the cam 46 is the lock tab 84. The lock tab 84 extends radially outwardly from the web 76, its edge forming a continuation of the straight edge 88. (See FIGS. 5A and 5B.) The lock tab 84 is thinner than the rim 78 and forms a co-planar surface with the lower edges of the rim 78. (See FIG. 5C.) The lock tab 84 cooperates with the safety lock 50 to hold the cam 46 in its latched position (see FIG. 3B) as is discussed more fully below.

The housing 44 (FIGS. 4A, 4B, and 4G) is configured to support the locking device 50. To this end an internal wall 66 extends down from the top wall 56 of the housing to form an insert well 72 which is sized and shaped to receive the safety lock mechanism 50. The insert well 72 is in the form of a cylindrical bore 73, and two slots 74 extend diametrically from the bore 73 along its entire length.

FIG. 7 shows the lock mechanism 50. The lock mechanism 50 is of a conventional design and includes an outer casing 118 and a tumbler assembly 120. The outer casing 118 is cylindrical and includes a pair of side wings 124 extending diametrically therefrom. In the assembled sashlock 40, the casing 118 is positioned within the housing's insert well 72 (defined by the internal wall 66). Specifically, the casing 118 is positioned within the bore 73 and the side wings 124 are positioned within the diametric slots 74. The bore 73 fits closely around the casing 118 and the wings 124 fit closely in the slots 74. Accordingly, the lock mechanism 50 cannot rotate with respect to the housing 44.

The tumbler assembly 120 includes a disk 126 at its upper end. This disk is proportioned to fit at least partially within an annular recess 128 formed in the top of the insert well 72. See FIGS. 4A and 4G. When the lock assembly 50 is inserted in the insert well 72, contact between the disk 126 and the recess 128 positions the lock, limiting its movement in one axial direction (to the right as viewed in FIG. 4G).

The lock casing 118 is also provided with an annular groove 130 which surrounds the lower end of the casing. The groove 130 is proportioned to receive a conventional snap ring (not shown). The groove 130 is positioned so that when the lock mechanism 50 is in the insert well 72 and the disk 126 is seated in the recess 128, the groove 130 is just clear of the lowermost end of the insert well. The snap ring 131 when installed in the groove 130, prevents movement of the lock mechanism in the opposite axial direction (to the left as viewed in FIG. 4G). Together the disk 126 and snap ring 131 prevent removal of the lock mechanism 50.

The lock mechanism 50 includes a block pin 132 which is rotatable with the tumbler assembly 120. The block pin 132 extends downward from the tumbler assembly 120 and is eccentric. Therefore, when the tumbler assembly is rotated 180° within its casing 118, the block pin 132 moves between the positions shown in FIGS. 3A and 3B. (One of these is shown in phantom in FIG. 7.)

As with most conventional lock mechanisms, the tumbler assembly 120 includes a slot 144 which receives a key 146. The key allows the tumbler assembly 120 to rotate, but when it is removed the tumbler assembly is locked against rotation. However, the particular type of lock mechanism is not significant. A device which uses a hexagonal (Allen) key could be used, or virtually any other that will fit in the space requirements.

In the assembled sashlock 40, the lock mechanism device 50 is positioned radially outward from all portions of the cam 46 except for its lock tab 84. Additionally, all portions of the lock mechanism 50, except for its block pin 132, are positioned above the cam's lock tab 84. When the locking device 50 is in the unlocked state, the block pin 132 is positioned outside the path 62 of the cam 46 in the housing 44. (See FIG. 3A). When the locking device 50 is in the locked state, the block pin 132 is positioned within the cam path 62. (See FIG. 3B).

FIGS. 8A through 8E show the keeper 42 in various views. The keeper 42 is shaped to be fastened to a rail of a sash and to capture the cam 46. To this end the keeper has a top wall 144 which forms an arch or bridge. Holes 150 are formed in each end of the bridge to receive fasteners such as the screws 43 shown in FIG. 2. The screws 43 hold the keeper to the sash rail 36. Between the two openings 150, the top wall 144 rises upward to form an opening 146. The opening 146 is proportioned to receive the cam 46. A dog or tooth 148 projects downward from the top of the arch of the wall 144. The dog 148 is captured by the inclined portion 79 of the cam 46 as the cam moves from the open to the closed position, eventually being positioned behind the rim 78 when the sashlock is in the locked position shown in FIG. 3B.

The operation of the lockable sash assembly 20 may be explained in detail by referring back to FIGS. 3A and 3B. When the sash assembly 20 is in its unlatched condition, the cam 46 is positioned entirely within the internal chamber 58 of the sashlock housing 44 and so is clear of the space 32 between the lower and upper sashes 24 and 26, respectively, as shown in FIG. 2. The cam hub's flat edge 88, the rim's rounded point 96, and the lock tab 84 are positioned flush with the inner wall 52. See FIG. 3A. When the cam 46 is in this window-openable position, the cam's stop pin 82 abuts the corresponding position-set tab 70 of the housing 44. (See FIG. 4C and FIGS. 5A and 5D.) The lever 48 is positioned in a position corresponding to the window-openable position of the cam 46.

In FIG. 3A, the locking device 50 is shown in the unlocked state in which the block pin 132 is clear of the path of the cam 46. As was explained above, the locking device 50 is positioned radially outward from all portions of the cam 46 when in the unlocked state. Accordingly, when the locking device 50 is in the unlocked state, the cam 46 may freely rotate by and past the locking device 50.

To convert the lockable sash assembly from the unlatched position to the latched position, the lever 48 is turned in the appropriate direction (counterclockwise as viewed in FIG. 3A) toward a position corresponding to the latched position of the cam 46. In the illustrated embodiment, the lever 48 will be moved approximately 180° in this process and the lock tab 84, will pass under the locking device 50. Once the lever 48 reaches the window-latched position, the lever's detents 108 will coordinate with the housing's set grooves 69 to "click" the lever 48, and thus the cam 46, into position. (See FIG. 4A and FIG. 6C.) The cam's position set pin 82 then abuts the position-set tab 71 of the housing 44. (See FIGS. 4B, 5A, and 5D.)

When the sashlock 40 is in the latched position, the flat edge 88 of the cam 46 is within the housing 44 and a portion of the cam 46 extends from within the housing across the space 32 between the sashes 24 and 26, through the keeper's opening 146 and behind the dog 148. (See FIGS. 3B, 4D, and 8C.) In this manner, the cam 46 forms a barrier preventing relative movement between the sashes 24 and 26.

When the sash assembly 20 is in the latched position, it may be placed in the locked state by changing the locking device 50 from the unlocked state to the locked state.

Specifically, the key 146 may be inserted into the key slot 144 (FIG. 2), and the tumbler assembly 120 then may be rotated approximately 180°. As was explained above, when the locking device 50 is in its locked state, the block pin 132 is positioned within the path of the cam 46, as shown in FIG. 3B. The pin 132 thus prevents movement of the cam 46 back toward the unlatched position because of the engagement between the pin and the lock tab 84 of the cam. Accordingly, until the key 146 is used to turn the locking device 50 back the unlocked state, the sashlock assembly 20 cannot be converted back to the unlatched position and thus the window assembly 22 cannot be opened.

One may now appreciate that a lockable sash assembly according to the present invention may be locked so that even if a blade is inserted into the gap between the two sashes to engage the rotating member, it will still not be possible to move the member back to its unlatched, window-openable position. Additionally, since in the preferred embodiment a key is necessary to turn the locking device to the unlocked state, the lockable sash assembly according to the present invention can also be used to control window openings inside the building.

Although the invention has been shown and described with respect to certain preferred embodiments, it is obvious that equivalent alternations and modifications will occur to others skilled in the art upon the reading and understanding of this specification. The present invention includes all such equivalent alterations and modifications and is limited only by the scope of the following claims.

What is claimed is:

1. A lockable sash assembly comprising:

a keeper defining an internal chamber which is capable of being mounted substantially flush with a face of a horizontal surface of an upper sash;

a sashlock assembly which is capable of being mounted substantially flush with a face of a horizontal surface of a lower sash wherein said sashlock assembly comprises:

a housing defined by walls which form a receiving chamber wherein said walls comprise an inner wall, an outer wall, and a top wall, wherein said top wall has radial lever-set grooves formed therein;

a rotating device which includes a cam which is shaped to conform to said receiving chamber and engage said keeper, wherein said cam is rotatable within said housing to an openable and unopenable position;

a lever operably coupled to said cam to assist said cam in rotation;

a handle attached to said lever having ridges which provides positive feel when said lever is at either of said lever's extreme positions when said ridges interact with said grooves in said top wall;

a hub which is included with said cam having an annular bottom surface; wherein said annular bottom surface of said hub is interrupted by said ridges wherein said ridges provide positive feel to said lever; and, a locking device in said top wall of said sashlock assembly positioned radially outward from said cam capable of converting said cam in said housing to an unopenable condition.

2. The lockable sash assembly of claim 1 further comprising:

a key slot wherein said key slot is included within said locking device and wherein upon insertion of an appropriately shaped key into said key slot said locking device will be converted from a locked state to an unlocked state;

an outer casing non-rotatably mounted to said housing;

a tumbler assembly within said casing, wherein the tumbler assembly is moveable relative to said casing.

3. The lockable sash assembly of claim 2 further comprising:

a block pin mounted to said tumbler assembly, said pin extending generally parallel to and offset from an axis of rotation of said tumbler assembly in said housing so that said pin sweeps out a circular path as said locking device is converted from its locked state to its unlocked state.

4. The lockable sash assembly of claim 2 further comprising:

a stop pin, wherein said stop pin is affixed to said cam;

a tab, wherein said tab is affixed within said housing and works in conjunction with said stop pin to limit said cam rotation to 180 degrees.

5. The lockable sash assembly according to claim 4 further comprising:

a lock tab which is positioned and shaped upon said cam so that when said rotating device is in a window-unopenable condition and said locking device is in a locked state, a force applied to said rotating device to rotate said rotating device toward the window openable position acts through said tab along a line that is tangent to said path of said tab and through a block pin along a line that is diametral to a path of movement of said pin.

6. The lockable sash assembly according to claim 1 wherein a wave washer is capable of being used to provide positive feel when the lever is at the extreme positions.

7. The lockable sash assembly according to claim 6 further comprising:

a dog formed in said internal chamber of said keeper;

a rim formed around said cam which interacts with said dog wherein said dog maintains a small gap there between said faces of said sashes when said cam of said sashlock is in a closed position and prevents prying.

8. The lockable sash assembly according to claim 7 further comprising:

a web included in said cam wherein said rim is attached to said web of said cam, wherein said rim has a rounded tip and is inclined to draw said sashes into alignment as said cam is rotated.

9. The lockable sash assembly according to claim 2 further comprising:

at least one side wing attached to said outer casing extending diametrically therefrom;

an insert well defined in said housing wherein said insert well is shaped to receive said side wing to prevent rotation of said outer casing.

10. The lockable sash assembly according to claim 9 further comprising:

an annular groove provided in said outer casing;

a recess formed in said insert well;

a disk seated in said recess to prevent removal of said locking device.

11. The lockable sash assembly according to claim 10 further comprising:

a snap ring positioned within said annular groove to prevent removal of said locking device.

12. A lockable sash assembly comprising:

a lower sash having a sash rail with a face having a horizontal surface;

an upper sash having a sash rail with a face having a horizontal surface wherein said lower sash is mounted parallel to said upper sash forming a small gap there between said faces of said sashes;

a keeper defining an internal chamber which when mounted is substantially flush with said face of said horizontal surface of said upper sash;

a dog formed in said internal chamber of said keeper;

a sashlock assembly which when mounted is substantially flush with said face of said horizontal surface of said lower sash wherein said sashlock assembly comprises:

a housing defined by walls which form a receiving chamber wherein said walls comprise an inner wall, an outer wall, and a top wall, wherein said top wall has radial lever-set grooves formed therein;

a rotating device which includes a cam which is shaped to conform to said receiving chamber and engage said keeper, wherein said cam is rotatable within said housing to an openable and unopenable position;

a rim formed around said cam which interacts with said dog wherein said dog maintains said small gap there between said faces of said sashes;

a hub having a central opening, said hub which is included in said cam has an annular bottom surface;

a lever having an end portion operably coupled to said central opening of said hub of said cam to assist said cam in rotation;

a handle attached to said lever having ridges which provides positive feel when the lever is at either of said lever's extreme positions when said ridges interact with said grooves in said top wall;

a locking device in said top wall of said sashlock assembly positioned radially outward from said cam capable of converting said cam in said housing to an unopenable condition, said locking device comprising:

a key slot wherein the key slot is included within said locking device and wherein upon insertion of an appropriately shaped key into said key slot said locking device will be converted from a locked state to an unlocked state;

an outer casing non-rotatably mounted to said housing;

a tumbler assembly within said casing, wherein the tumbler assembly is moveable relative to the casing;

a block pin mounted to said tumbler assembly, said pin extending generally parallel to and offset from the axis of rotation of said tumbler assembly in said housing so that said pin sweeps out a circular path as said locking device is converted from its locked state to its unlocked state.

13. The lockable sash assembly of claim 12 further comprising:

a stop pin, wherein said stop pin is affixed to said cam;

a tab, wherein said tab is affixed within said housing and works in conjunction with said stop pin to limit said cam rotation to 180 degrees.

14. The lockable sash assembly according to claim 12 further comprising:

a lock tab is positioned and shaped upon said cam so that when said rotating device is in a window-unopenable condition and said locking device is in a locked state, a force applied to said rotating device to rotate said rotating device toward the window openable position acts through said tab along a line that is tangent to said path of said tab and through said block pin along a line that is diametral to a path of movement of said pin.

15. The lockable sash assembly according to claim 12 further comprising:

a web included in said cam wherein said rim is attached to said web of said cam, wherein said rim has a rounded tip and is inclined to draw said sashes into alignment as said cam is rotated.

16. The lockable sash assembly according to claim 12 further comprising:

at least one side wing attached to said outer casing extending diametrically therefrom;

an insert well defined in said housing wherein said insert well is shaped to receive said side wing to prevent rotation of said outer casing.

17. The lockable sash assembly according to claim 16 further comprising:

an annular groove provided in said outer casing;

a recess formed in said insert well;

a disk seated in said recess to prevent removal of said locking device.

18. The lockable sash assembly according to claim 17 further comprising:

a snap ring positioned within said annular groove to prevent removal of said locking device.

* * * * *